United States Patent [19]

Ogushi et al.

[11] Patent Number: 4,576,009

[45] Date of Patent: Mar. 18, 1986

[54] HEAT TRANSMISSION DEVICE

[75] Inventors: Tetsurou Ogushi, Kawanishi; Masaaki Murakami, Itami, both of Japan

[73] Assignee: Mitsubishi Denki Kabushiki Kaisha, Tokyo, Japan

[21] Appl. No.: 693,151

[22] Filed: Jan. 22, 1985

[30] Foreign Application Priority Data

| | | | |
|---|---|---|---|
| Jan. 31, 1984 | [JP] | Japan | 59-15887 |
| Jan. 31, 1984 | [JP] | Japan | 59-15888 |
| Feb. 15, 1984 | [JP] | Japan | 59-26473 |

[51] Int. Cl.[4] ..... F25B 21/02

[52] U.S. Cl. ..... 62/3; 62/159

[58] Field of Search ..... 62/3, 159

[56] References Cited

U.S. PATENT DOCUMENTS

| | | | |
|---|---|---|---|
| 420,641 | 2/1890 | Dewey | 62/3 |
| 2,910,836 | 11/1959 | Karrer | 62/159 X |
| 2,966,033 | 12/1960 | Hughel | 62/3 |
| 3,324,667 | 6/1967 | Muller | 62/3 |
| 3,378,062 | 4/1968 | Ringquist et al. | 62/159 X |
| 3,552,133 | 1/1971 | Lukomsky | 62/3 |
| 4,065,936 | 1/1978 | Fenton et al. | 62/3 |
| 4,472,945 | 9/1984 | Cech et al. | 62/3 |

FOREIGN PATENT DOCUMENTS 1558551 1/1980 United Kingdom .

OTHER PUBLICATIONS

Device for Passive Downward Heat Transport: Design Criteria and Operational Results, G. De Beni, et al., pp. 673–683.

*Primary Examiner*—Lloyd L. King

*Attorney, Agent, or Firm*—Oblon, Fisher, Spivak, McClelland & Maier

[57] ABSTRACT

A heat transmission device comprises a heat receiving part, a heat radiating part, and a looped pipeline connecting these parts in which a working fluid having condensing properties as a heat transferring medium is filled in the pipeline. A plurality of accumulators are interposed in a parallel arrangement in the pipeline at the upper stream of the heat receiving part but at the downstream of the heat radiating part; there are provided a heating/cooling means for heating and cooling the accumulators, and a control means which performs alternately the first operation of feeding the working fluid condensed at the heat radiating part to at least one of the accumulators and the second operation of circulating the working fluid in the at least one accumulator to the heat receiving part and performs alternately the first and second operations in the reverse order for the other accumulator.

15 Claims, 12 Drawing Figures

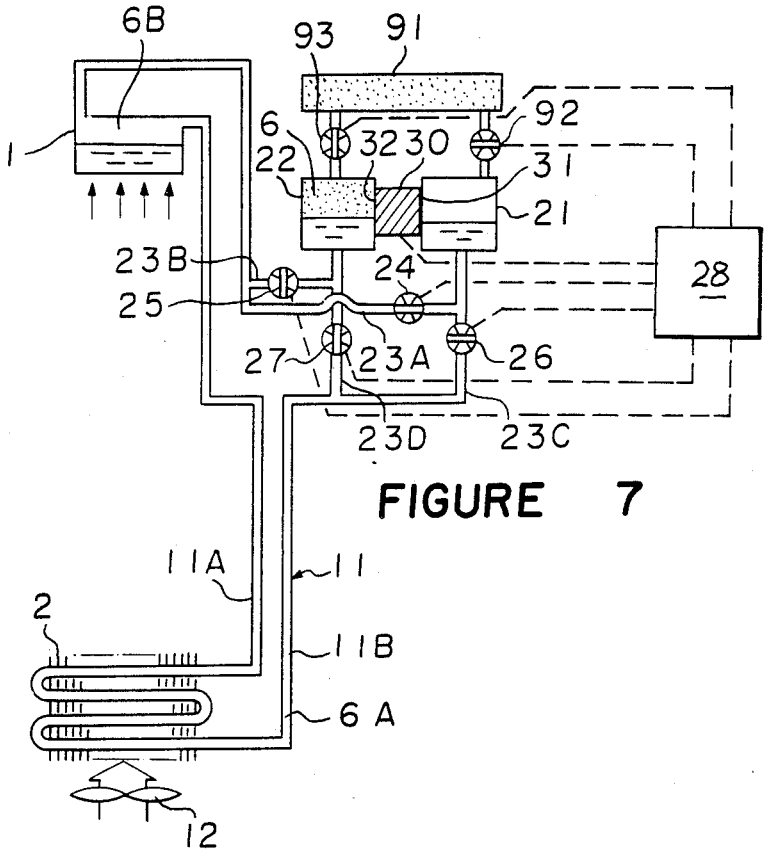
FIGURE 7
FIGURE 8
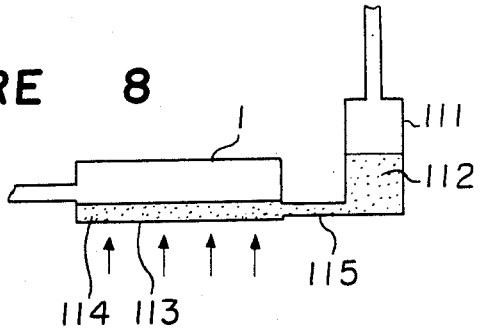
FIGURE 9
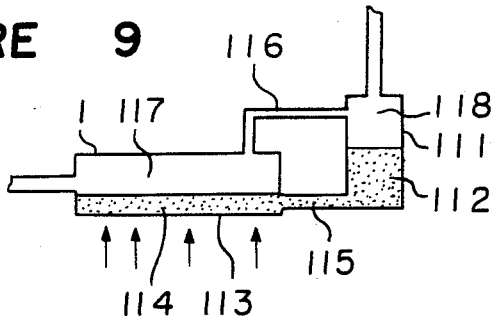

HEAT TRANSMISSION DEVICE

BACKGROUND OF THE INVENTION

1. Field of the Invention

The present invention relates to a heat transmission device used for an air conditioner and so on.

2. Description of Prior Art

Heat transmission devices generally have such a construction that a heat transferring medium is confined in a pipeline to utilize change in phase between liquid and vapor of the medium; specifically, heat absorbed at a heat receiving part is transferred to a heat radiating part to be radiated.

FIG. 1 shows a conventional heat transmission device disclosed, for instance, in Japanese Unexamined Utility Model Application No. 66381/1952, in which a reference numeral 1 designates a heat receiving part connected to the upper part of the pipeline; a numeral 2 designates a heat radiating part arranged vertically in the lower portion of the pipeline; numerals 3A, 3B designate first and second check valves which allow fluid to flow in only one direction and a numeral 4 designates an accumulator. There are provided a pipeline 5A between the heat receiving part 1 and the heat radiating part 2, a pipeline 5B between the heat radiating part 2 and the first check valve 3A, a pipeline 5C between the first check valve 3A and the second check valve 3B and a pipeline 5D between the second check valve 3B and the heat receiving part 1; thus, all the pipelines constitute a looped pipeline, namely a closed pipeline. The accumulator 4 and the pipelines connected to the accumulator 4 contain a suitable amount of a working fluid 6 such as freon, methyl alcohol as a heat transferring medium. At the side of the accumulator 4 and above the heat receiving part 1 in the pipeline 5D, there is provided a sealed chamber 7 which is so constructed that as shown in FIG. 2, a reservoir 8 is pivotally supported in the sealed chamber 7 so as to be turned around a supporting point O and when there is no liquid in the reservoir 8, the center of gravity $G_1$ shifts below the supporting point O so that an opening of the reservoir is directed upward; on the other hand, when there is a predetermined amount of liquid in the reservoir 8, the center of gravity $G_2$ shifts above the supporting point O so that the opening of the reservoir 8 is automatically directed downward by turning of it around the supporting point O. In FIG. 1, when assuming that the working fluid 6 in liquid phase is referred to as liquid 6A and the working fluid 6 in gaseous phase is referred to as vapor 6B, the liquid 6A is filled in the pipelines at the actuation of the device.

Now, if heat is supplied to the heat receiving part 1, there is produced a high pressure vapour 6B corresponding to the temperature of the liquid 6A in the heat receiving part 1 to cause pressure difference between the heat receiving part 1 and the accumulator 4. Since high pressure condition is produced in the heat receiving part 1, the liquid 6A in the pipeline 5A, the heat radiating part 2 and the pipeline 5B flows into the accumulator 4 whereby pressure in the accumulator 4 is gradually increased.

The vapor 6B produced in the heat receiving part 1 is fed through the pipeline 5A to the heat radiating part 2 where it is cooled and emits heat of condensation to become liquid. Liquefaction of vapor is restricted by both temperature in the heat receiving part and temperature in the heat radiating part. As a result, the pressure of the vapor 6B in the heat receiving part 1, the pipeline 5A and the heat radiating part 2 is the saturated vapor pressure corresponding to temperature of the intermediate of the heat receiving part and the heat radiating part. Accordingly, the pressure of the accumulator 4 is maintained at the level of the saturated vapor pressure during continuation of vaporization of the liquid 6A in the heat receiving part 1.

In this condition and during feeding of the vapor 6B produced in the heat receiving part 1 to the heat radiating part 2 for liquefaction, heat in the heat receiving part 1 is transferred to the heat radiating part 2 and the transfer of heat is continued until there is no liquid 6A in the heat receiving part 1. When the liquid 6A is entirely vaporized in the heat receiving part 1, the pressure of the vapor 6B in the heat receiving part 1, the pipeline 5A and the heat radiating part 2 is lowered due to the temperature of the heat radiating part 2, with the result that there causes pressure difference between the accumulator 4 and the heat receiving part 1. Since pressure in the accumulator 4 is higher than in the heat receiving part 1, the liquid 6A stored in the accumulator 4 is circulated to the heat receiving part 1 through the second check valve 3B. In this case, the liquid 6A does not reach the heat receiving part 1 immediately and it is temporarily stored in the reservoir 8 of the sealed chamber 7 interposed in the pipeline 5D. Namely, when the reservoir 8 contains a predetermined amount of the liquid 6A, the center of gravity $G_2$ shifts above the supporting point O so that the reservoir 8 is turned to discharge the liquid 6A to the heat receiving part 1 at once. As a result, a large amount of the liquid 6A can be supplied to the heat receiving part 1 whereby the heat receiving part 1 is effectively actuated. By repeating the operations as above-mentioned, heat from the heat receiving part 1 located at the higher portion can be transferred to the lower heat radiation part 2 without using any power.

In the heat transmission device of this kind, however, when the liquid 6A in the heat receiving part 1 is entirely vaporized to produce a pressure difference between the accumulator 4 and the heat receiving part 1, the liquid 6A is once stored in the accumulator 4 and then is supplied to the heat receiving part 1. Accordingly, a stream of the vapor flowing to the heat radiating part 2 must be stopped. As a result, the quantity of heat to be transferred from the heat receiving part 1 to the heat radiating part 2 is decreased or stopped thereby causing pulsation during the transfer of heat.

SUMMARY OF THE INVENTION

It is an object of the present invention to provide a heat transmission device of a simple structure and for preventing pulsation in heat transfer.

The foregoing and the other objects of the present invention have been attained by providing a heat transmission device comprising a heat receiving part, a heat radiating part and a looped pipeline connecting these parts in which a working fluid having condensing properties as a heat transferring medium is filled in the pipeline, characterized by comprising a plurality of accumulators interposed in a parallel arrangement in the pipeline at the upper stream of the heat receiving part but at the downstream of the heat radiating part; a heating-/cooling means for heating and cooling the accumulators and a control means which performs alternately the first operation of feeding the working fluid condensed at the heat radiating part to at least one of the accumulators and the second operation of circulating the working fluid in the at least one accumulator to the heat receiving part and performs alternately the first and second operations in the reverse order for the other accumulator.

BRIEF DESCRIPTION OF DRAWING

FIGS. 4 to 7 are respectively fluid circuit diagrams showing other embodiments of the present invention;

FIG. 8 is a schematic view of an embodiment of a heat receiving part used in the heat transmission device according to the present invention;

FIG. 9 is a schematic view of another embodiment of the heat receiving part of the present invention;

DETAILED DESCRIPTION OF PREFERRED EMBODIMENTS

Figure 1:
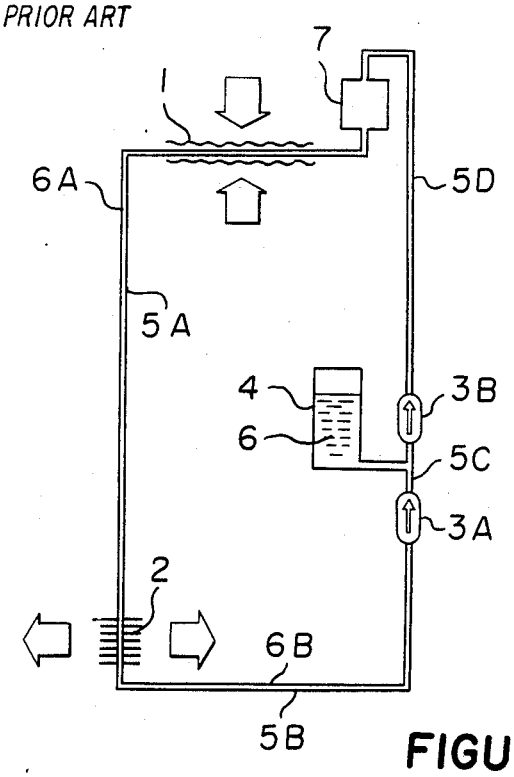
FIGURE 1 PRIOR ART
FIG. 1 is a diagram showing a conventional heat transmission device.
Figure 2:
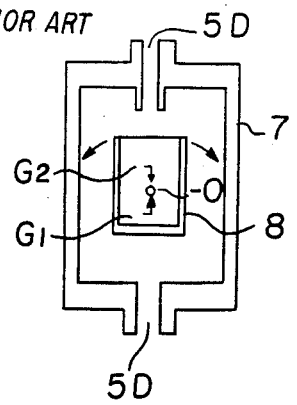
FIGURE 2 PRIOR ART
FIG. 2 is a schematic view of a sealed chamber used in the conventional device.
Figure 3:
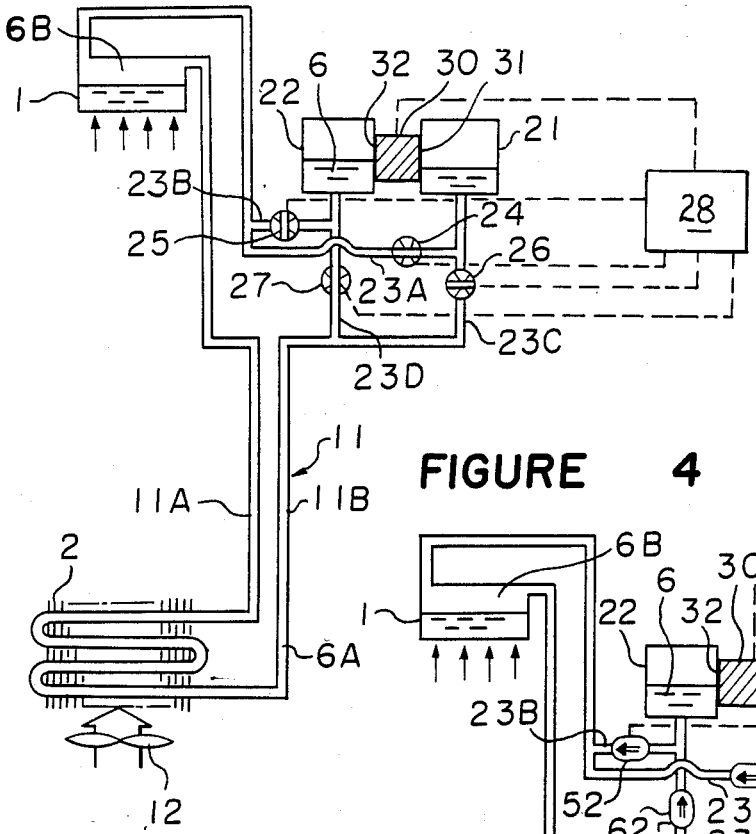
FIG. 3 is a fluid circuit diagram of an embodiment of the heat transmission device according to the present invention.

FIG. 3 shows a fluid circuit of the heat transmission device according to the present invention. In FIG. 3, a reference numeral 1 designates a heat receiving part, a numeral 2 designates a heat radiating part, and a numeral 6 designates a working fluid having condensing properties such as freon, methyl alcohol as a heat transferring medium. A suitable amount of the working fluid 6 is filled in a pipeline 11 in a looped form in which the heat receiving part 1 and the heat radiating part 2 are connected. A blast fan 12 is provided in the heat radiating part 2 to perform effective heat radiation.

A plurality of accumulators, (two accumulators 21, 22 in this embodiment) are provided in the pipeline which connects the upstream side of the heat receiving part 1 to the downstream side of the heat radiating part 2, the accumulators being connected in parallel to the pipeline 11. The accumulators 21, 22 are respectively referred to as the first and the second accumulators. A pipeline 11A connects the downstream side of the heat receiving part 1 to the upstream side of the heat radiating part 2 and a pipeline llB connects the upstream side of the heat receiving part 1 to the downstream side of the heat radiating part 2. The pipeline 11B is branched at the side of the heat receiving part 1 to be a pipeline 23A which communicates the first accumulator 21 with the heat receiving part 1 and a pipeline 23B which communicates the second accumulator 22 with the heat receiving part 1. The pipeline 11B is also branched at the side of the heat radiating part 2 to be a pipeline 23C which communicates the first accumulator 21 with the heat radiating part 2 and a pipeline 23D which communicates the second accumulator 22 with the heat radiating part 2. Switch valves 24–27 respectively provided in the branched pipelines 23A–23D as switching means for selectively opening and closing the pipelines. Specifically, the first switching valve 24 is interposed in the pipeline 23A, the second switching valve 25 in the pipeline 23B, the third switching valve 26 in the pipeline 23C and the fourth switching valve 27 in the pipeline 23D.

The first to the fourth switching valves 24–27 are operated in association with each other by a control unit 28 to control operations of the accumulators 21, 22. Namely, the control unit 28 makes the first condition by opening both the first and the fourth switching valves 24, 27 and closing both the second and the third switching valves 25, 26 and the second condition by closing both the first and the fourth switching valves 24, 27 and by opening both the second and the third switching valves 25, 26. The first and the second conditions are alternately changed at suitable time intervals.

A reference numeral 30 designates a thermoelectric element utilizing Peltier effect which is used as a heating/cooling means for heating and cooling the first and the second accumulators 21, 22. The thermoelectric element 30 is provided between the accumulators 21, 22 with its one surface 31 being in contact with the first accumulator 21 and its other surface 32 being in contact with the second accumulator 22. The thermoelectric element 30 is controlled by the control unit 28 so as to perform alternately generation of heat and absorption of heat in the surfaces 31, 32 by changing the direction of current flowing in the element 30. Change of the flowing direction of the current is carried out in such a manner that when the first to the fourth switching valves 24–27 are in the first condition, the surface 31 of the thermoelectric element 30 generates heat while the surface 32 absorbs heat, and when the switching valves 24–27 are in the second condition, the surface 31 of the thermoelectric element 30 absorbs heat while the surface 32 generates heat.

In the heat transmission device constructed as abovementioned, when the device is in the first condition as shown in FIG. 3, the vapor 6B produced in heat receiving part 1 is fed through the pipeline 11A to the heat radiating part 2 where it is cooled to be condensed. The condensed liquid 6A is supplied to the second accumulator 22 through the pipeline 11B and the fourth switching valve 27 provided in the pipeline 23D, during which heat absorbed in the heat receiving part 1 is transferred to the heat radiating part 2. At the moment, the second switching valve 25 is closed and accordingly the vapor does not directly flows from the heat receiving part 1 through the pipeline 23B to the accumulator 22. In this case, the first switching valve 24 is opened and the third switching valve 26 is closed. In this state, a voltage is applied to the thermoelectric element 30 so as to heat the first accumulator 21 and to cool the second accumulator 22 whereby inner pressure of the first accumulator 21 becomes higher than that of the second accumulator 22 thereby generating a driving force to feed the liquid from the first accumulator 21 to the second accumulator 22. As a result, the liquid in the first accumulator 21 is circulated to the heat receiving part 1 through the pipeline 23A and the first switching valve 24. In other words, the working fluid 6 is supplied to the heat receiving part 1.

On the other hand, after lapse of a predetermined period or by detection of the surface of the liquid in the accumulators 21, 22, the first to the fourth switching valves 24–27 and thermoelectric element 30 are switched by the control unit 23 to render the surface 31 of the element 30 to be in a state of heat absorption and the surface 32 to be in a state of heat generation.

When the first condition is changed to the second condition such that the first and the fourth switching valves 24, 27 are closed and the second and the third switching valves 25, 26 are opened, the vapor 6B produced in the heat receiving part 1 is liquefied in the heat radiating part 2 and the liquid flows into the first accumulator 21. Thus, in the second condition, the transfer of heat is carried out as the same manner as the first condition provided that the liquid is circulated from the second accumulator 22 to the heat receiving part 1.

Thus, by switching the first to the fourth switching valves 24–27 and by changing the direction of current fed to the thermoelectric element 30, the working fluid 6 is circulated to the heat receiving part 1 continuously by switching the operations of the accumulators 21, 22 during reflux of the working fluid 6 to the heat receiving part 1.

Accordingly, the vapor in the heat receiving part 1 can be continuously supplied to the heat radiating part 2 without causing entire evaporation of the working fluid in the heat receiving part 1 thereby reducing pulsation of heat to be transferred. This minimizes variations in the quantity of heat to be transferred to result in the increase of heat transferring efficiency. Further, since the heat transmission device of the present invention does not utilize gravity for circulating the liquid, the transfer of heat can be carried out even when the accumulators 21, 22 are located below the heat receiving part 1 or there is a large pressure loss in the heat receiving part 1 and the heat radiating part 2. In addition, the present invention is applicable under a gravity-free condition, for instance, even when the heat transmission device is placed in space. That is, there is provided the control unit 28 which performs the first operation and the second operation alternately for at least one of the accumulators by using the first to the fourth switching valves 24, 27 and which performs the first operation and the second operation alternately in the reverse order for the other accumulators, in which the first operation is to feed the working fluid 6 condensed in the heat radiation part 2 to the at least one accumulator and the second operation is to circulate the working fluid 6 in the other accumulators to the heat receiving part 1. Further effective operations of supply of the working fluid 6 to the heat receiving part 1 or the accumulators can be obtained by heating and cooling the accumulators by means of the thermoelectric element 30.

Figure 4:
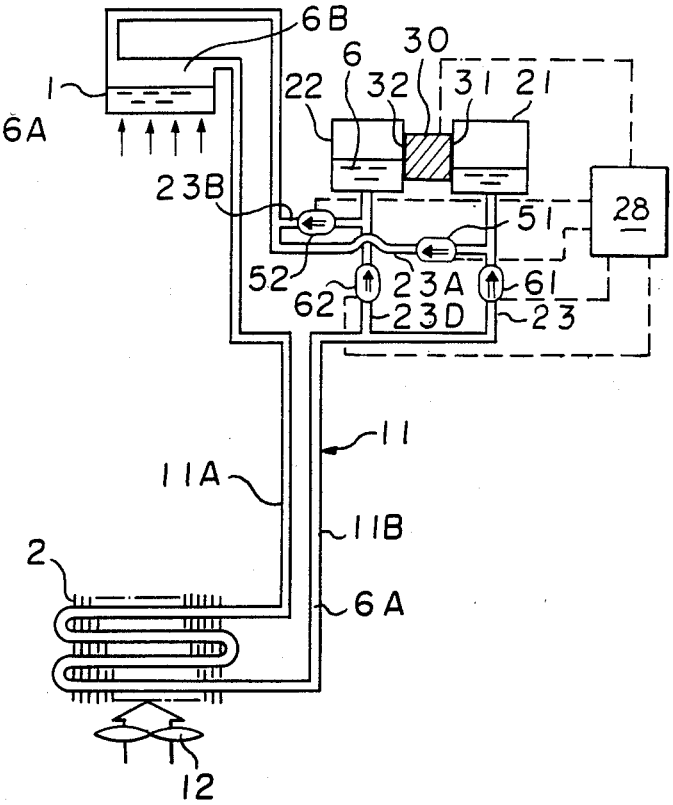

FIG. 4 is a fluid circuit diagram showing another embodiment of the present invention in which the control unit 28 for performing the same function as the previously mentioned embodiment controls first to fourth check valves 51, 52, 61, 62 instead of the first to the fourth switching valves 24, 25, 26 and 27 as shown in FIG. 3. The first check valve 51 is interposed in the pipeline 23A to feed the liquid only from the first accumulator 21 to the heat receiving part 1, the second check valve 52 is in the pipeline 23B to feed the liquid only from the second accumulator 22 to the heat receiving part 1, the third check valve 61 is in the pipeline 23C to feed the liquid only from the heat radiating part 2 to the first accumulator 21 and the fourth check valve 62 is in the pipeline 23D to feed the liquid only from the heat radiating part 2 to the second accumulator 22.

In the embodiment, pressure difference is produced between the first and the second accumulators 21, 22 by changing the direction of current fed to the thermoelectric element 30 for heating and cooling whereby the first and the second conditions are changed.

Figure 5:
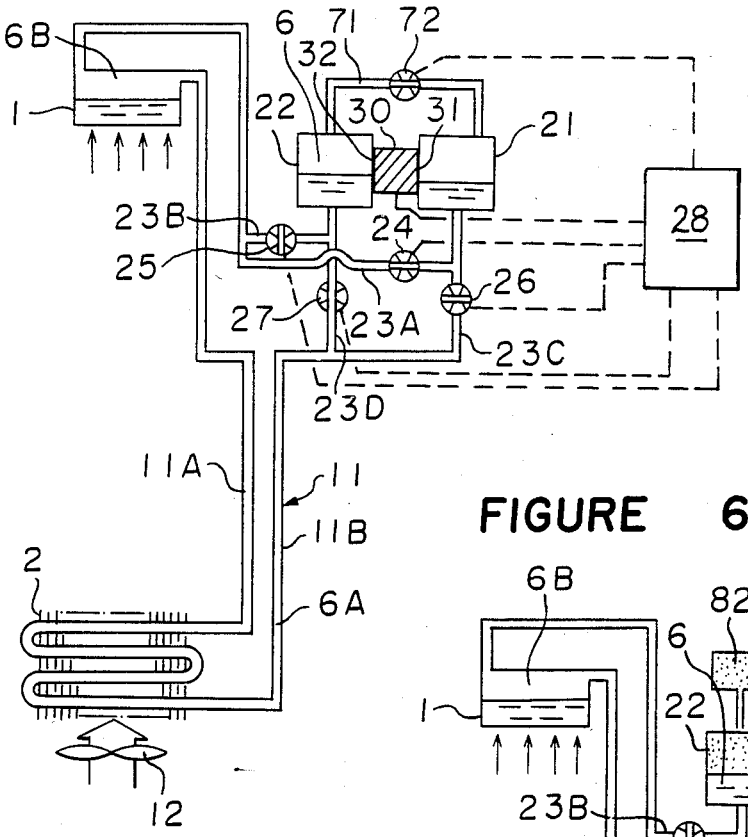

FIG. 5 shows a modified embodiment of the heat transmission device. In FIG. 5, a pressure-equalizing pipe 71 is provided to communicate the first accumulator 21 with the second accumulator 22 to equalize the inner pressure of them for the purpose that pressure difference between the first and the second accumulators 21, 22 is smoothly reversed. Namely, a fifth switching valve 72 as a switching means which is interposed in the pressure-equalizing pipe 71 is opened at the same time of changing the first condition to the second condition and vice versa in synchronism with the operations of the first to the fourth switching valves and after lapse of a predetermined time it is closed.

The operation of the modified embodiment will be described. When the switching valve 72 is controlled to be in an opening state at the time of switching the first to the fourth switching valves 24–27, pressure in the first accumulator 21 instantaneously becomes equal to pressure in the second accumulator 22. After that, the switching valve 72 is brought into a closed state and heating and cooling function to the surfaces of the thermoelectric element 30 is reversed whereby the pressure difference between the accumulators 21, 22 is reversed. As a result, the pressure difference between the first and the second accumulators 21, 22 is reversed for a short time when the first to the fourth switching valves 24–27 are switched.

Figure 6:
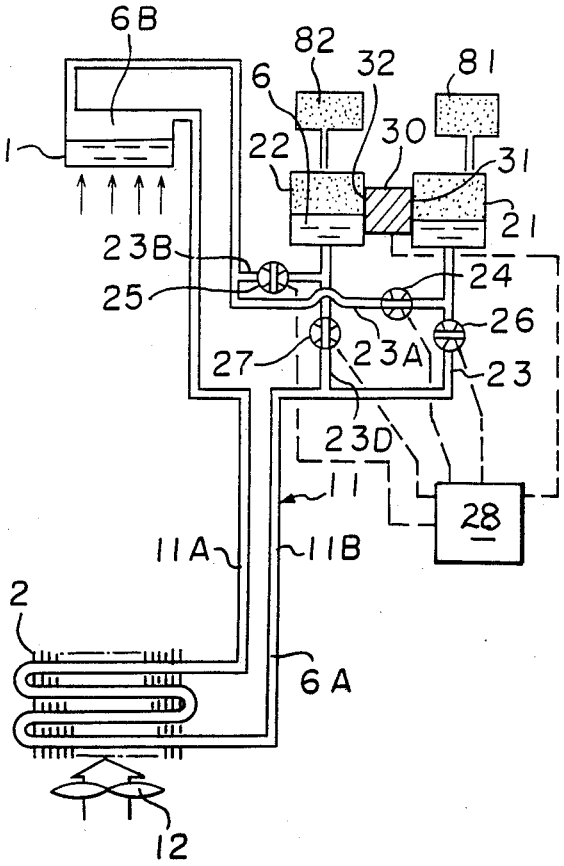

FIG. 6 is a fluid circuit diagram showing a separate embodiment of the present invention. In FIG. 6, first and second gas reservoirs 81, 82 each filled with gas of non-condensing properties such as nitrogen, helium, are respectively connected to the first and the second accumulators 21, 22. Accordingly, pressure in the first and the second accumulators 21, 22 are respectively controlled by the pressure of the first and the second gas reservoirs 81, 82 to reduce the magnitude of variations in pressure. As a result, the pressure in the heat receiving part 1 is not easily affected by variations in input of heat energy at the heat receiving part 1 whereby temperature of the heat receiving part 1 is controlled without being affected by variations in the input of heat energy.

FIG. 7 shows still another embodiment of the present invention. In FIG. 7, a single gas reservoir 91 is commonly used and it is connected to the first and the second accumulators 21, 22 through respective pipelines in which sixth and seventh switching valves 92, 93 are respectively interposed. The sixth and the seventh switching valves 92, 93 operate in association with the third and the fourth switching valves 26, 27. Namely, in the first condition, the surface 31 of the thermoelectric element 30 is heated while the surface 32 absorbs heat and the first, the fourth and the seventh switching valves 24, 27, 93 are all in opening states while the second, the third, the sixth switching valves 25, 26, 92 are all in closing states. In this case, pressure in the first accumulator 21 is not affected by the gas reservoir 91 since the sixth switching valve 92 is closed and the second accumulator 22 is affected by the gas reservoir 91 since the seventh switching valve 93 is opened. Accordingly, the inner pressure of the first accumulator 21 is smoothly increased and variation in pressure of the second accumulator 22 can be small. As a result, there is obtainable temperature controlling function so that temperature in the heat receiving part 1 is not caused substantial change by the variations in input of heat energy as is the embodiment shown in FIG. 6. The embodiment of FIG. 7 provides advantages of a single gas reservoir and of smooth switching operation due to use of non-condensing gas. The same effect can be obtained by connecting the sixth switching valve 92 between the first accumulator 21 and the first gas reservoir 81 and by connecting the seventh switching valve 93 between the second accumulator 22 and the second gas reservoir 82 as shown in FIG. 6.

In the embodiments, the control unit 28 can comprise either timers and so on operated at fixed period detectors for detecting variations in the height of the surface of liquid contained in the heat receiving part 1 or the first and the second accumulators 21, 22. Of the two ways above-mentioned, the way of switching of the switching valves by detection of the liquid surface in the heat receiving part 1 is especially advantageous. The reason is that overheating of the heat receiving part 1 is avoided because there is no shortage of liquid in the heat receiving part 1 thereby increasing reliability of the device and increasing heat transferring efficiency.

In the several embodiments, description has been made as to use of two accumulators. The present invention is applicable to a heat transmission device having a larger number of accumulators. As described above, the heat transmission device of the present invention is so constructed that a plurality of accumulators are provided in a fluid circuit including a heat receiving part and a heat radiating part and a heating/cooling means is provided for the accumulators to produce pressure difference between at least one of the accumulators in heated condition and the other accumulator in cooled condition. Thus formed pressure difference is utilized to circulate a working fluid to the heat receiving part. Further, there is provided a control means for controlling the working fluid fed to the accumulator and the working fluid circulated to the heat receiving part so that the working fluid can be continuously circulated to the heat receiving part by switching the connection of the accumulators between the accumulator for circulating the working fluid to the heat receiving part and the accumulator receiving the working fluid from the heat radiating part.

With the construction of the heat transmission device, there causes no entire evaporation of the working fluid in the heat receiving part and vapor in the heat receiving part is continuously supplied to the heat radiating part to thereby reduce variations in the quantity of heat to be transferred and to prevent pulsation of heat.

FIGS. 8–9 shows modified embodiments of the heat receiving part used in the heat transmission device of the present invention.

In FIGS. 8–9, the same reference numerals designate the same or corresponding parts shown in FIGS. 1–7.

FIG. 8 shows a first embodiment of the heat receiving part in which a reference numeral 111 designates a liquid storage chamber formed in a pipeline for connecting the heat receiving part 1 to accumulators 21, 22. The liquid storage chamber 111 has its inner sectional area larger than that of the pipeline and a first porous material 112 is packed inside the liquid storage chamber. On the other hand, the heat receiving surface 113 of the heat receiving part 1 has an inner lining of a second porous material 114 bonded by an adhesive. The second porous material 114 and the first porous material 112 are connected through a third porous material 115 packed in a pipeline for connecting the liquid storage chamber 111 to the heat receiving part 1. For the first to the third porous materials 112, 114, 115, a material having numerous numbers of fine pores or voids such as a resinous material used for filters, ceramics may be used.

The pore diameter of the second porous material 114 is made smaller than that of the first porous material 112 because the pore diameter and porosity of the first porous material 112 should be relatively large for the purpose of storing a large amount of liquid in the liquid storage chamber 111 and the pore diameter of the second porous material 114 should be relatively small for the purpose of obtaining capillary function.

As described before, the working fluid 6 is circulated by the generation of pressure difference between pressure in the accumulator 21 or 22 and pressure in the heat receiving part 1 in which the liquid 6A is entirely evaporated. When supply of the liquid 6A from the accumulator 21 or 22 is initiated, the liquid 6A is first stored in the liquid storage chamber 111 containing the first porous material 112, but the liquid 6A does not immediately reach the heat receiving part 1 unlike the conventional device. Then, the liquid is returned to the heat receiving surface 113 through the first porous material 112 and the third and the second porous marterials 115, 114. The speed of the liquid 6A in the porous materials is lower than that of the liquid 6A flowing from the pipeline to the liquid storage chamber 111, on account of which a predetermined amount of the liquid 6A is stored in the liquid storage chamber 111 while the liquid reaches the heat receiving surface 113 of the heat receiving part 1. As a result, the liquid 6A stored in the liquid storage chamber 111 can be effectively supplied to the entire surface of the heat receiving surface 113 due to capillary function even after supply of the liquid from the accumulator 21 or 22 to the heat receiving part is stopped.

Accordingly, when pressure difference is produced between the accumulator 21 or 22 and the heat receiving part 1 in which the liquid 6A is entirely evaporated, supply of the liquid 6A to the heat receiving part 1 is maintained. In the embodiment of the present invention, it is possible to transfer heat under gravity-free condition because the liquid is supplied to the heat receiving part 1 due to capillary action.

FIG. 9 shows another embodiment of the heat receiving part used for the heat transmission device of the present invention.

In this embodiment, an equalizing pipe 116 is connected between the heat receiving part 1 and the liquid storage chamber 111 to communicate a vapor phase portion 117 in the heat receiving part 1 with a vapor phase portion 118 in the liquid storage chamber 111.

In the heat transmission device constructed as above-mentioned, the equalizing pipe 116 equalizes pressure in the vapor phase portion 117 of the heat receiving part 1 to pressure in the vapor phase portion 118 of the liquid storage chamber 111, with the result that the pressure of the vapor phase portion 117 is higher than the pressure of the vapor phase portion 118 whereby a pressure of the opposite direction is applied to the stream of liquid in the first through third porous materials 112, 114, 115 to prevent a stream of the liquid from being blocked. Thus, there takes place a stream of the liquid in the first and the second porous materials 112, 114 through the pipeline between the liquid storage chamber 111 and the heat receiving part 1.

Thus, the liquid circulated from the accumulator by evaporation of the working fluid is once stored in the liquid storage chamber and then the stored liquid is supplied to the heat receiving part due to the capillary action of the porous materials. As a result, the liquid stored in the liquid storage chamber can be effectively supplied to the heat receiving part even though a stream of the liquid from the accumulator is stopped.

Figure 10:
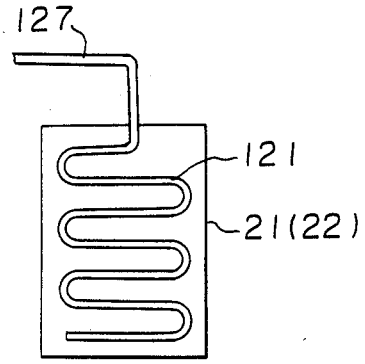
FIG. 10 is a schematic view of an embodiment of an accumulator used in the heat transmission device according to the present invention.
Figure 11:
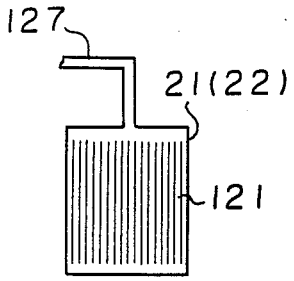
FIGS. 11 and 12 are respectively diagrams showing other embodiments of the accumulator of the present invention.
Figure 12:
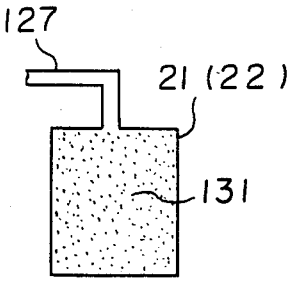

FIGS. 10–12 show modified embodiments of the accumulator used for the heat transmission device of the present invention. In FIGS. 10–12, the same reference numerals designate the same or corresponding parts.

In FIG. 10, a reference numeral 127 designates a communicating pipe which is provided at the upper part of the accumulator 21 or 22 and is connected to the pipeline 11 at the upper stream side of the switching valve 26 or 27 (or the check valve 61 or 62), the pipeline 11 being formed in a loop in which the heat receiving part 1 and the heat radiating part 2 are connected.

A reference numeral 121 designates a capillary tube as a phase-separation preventing means which prevents the working fluid 6 filled in the accumulators 21, 22 and the pipeline 11 from causing phase-separation into gas and liquid. The capillary tube 121 has a diameter smaller than that of the communicating pipe 127 and a large length to obtain capillary action. One end of the capillary tube is connected to the communicating pipe 127 and the other end is opened near the bottom of the accumulator. The capillary tube 121 is formed in a corrugated form to reduce the size and is put in each of the accumulators 21, 22.

When there is produced pressure difference between the heat receiving part 1 and the accumulator 21 or 22, the liquid in the pipeline 11A, the heat radiating part 2 and the pipeline 11B flow into the accumulator 21 or 22 through the switching valve 26 or 27 and the communicating pipe 127, capillary action by the capillary tube 121 prevents the liquid 6A from dropping onto the bottom of the accumulator 21 or 22. Further, the capillary tube 121 condenses the vapor 6B because vapor pressure is in proportion to the radius of curvature of a surface to which vapor is in contact. Accordingly, when the radius of curvature is small, the vapor pressure is also small and there takes place condensation under the same pressure even at higher temperature whereby the curved parts of the capillary tube 121 induce the vapor 6B thereby causing condensation.

Thus, the capillary tube 121 prevents the working fluid 6 fed in the accumulator 21 or 22 from causing phase separation into the liquid 6A and the vapor 6B. Accordingly, pressure in the heat receiving part 1 becomes lower than that in the accumulator 21 or 22 to thereby preventing discharge of the vapor 6B at the same time of or prior to discharging of the liquid 6A from the accumulator 21 or 22 when the working fluid 6 in the accumulator is discharged to the heat receiving part 1. As a result, time required for circulating a predetermined amount of the liquid 6A is shortened to improve efficiency of transferring heat.

In the embodiment of the present invention, phase-separation of the working fluid 6 is eliminated by utilizing capillary action and accordingly there is obtainable the transfer of heat without causing phase-separation even under gravity-free condition.

FIG. 11 shows another embodiment of the accumulator used for the heat transmission device of the present invention. In FIG. 11, the accumulators 21, 22 receive a large number of linear capillary tubes 121 with both ends opened, as a phase-separation preventing means. The capillary tubes 121 have a length corresponding to the height of the inside of the accumulators 21, 22 and are arranged vertically in parallel with each other.

In FIG. 12, the accumulator 21 or 22 contains porous material 131 as a separation preventing means. For the porous material 131, material having numerous number of fine pores or fine spaces such as resinous material used for a filter or ceramics may be used.

In the heat transmission device having the accumulator as above-mentioned, the working fluid 6 can be condensed by means of capillary tubes 121 or the porous material 131 having fine pores or fine spaces to prevent the working fluid 6 from causing phase-separation. Accordingly, time required for circulating a predetermined amount of the liquid 6A in the accumulators 21, 22 can be shortened.

What is claimed is:

1. A heat transmission device comprising:

(a) a heat receiving part;

(b) a heat radiating part;

(c) a looped pipeline connecting said heat receiving part and said heat radiating part, said looped pipeline containing, during use, a working fluid having condensing properties as a heat transferring medium;

(d) a plurality of accumulators interposed in a parallel arrangement in said pipeline upstream of said heat receiving part but downstream of said heat radiating part;

(e) a heating/cooling means for heating and cooling said accumulators;

(f) a control means which performs alternately the first, operation of feeding said working fluid condensed at said heat radiating part to a first one of said accumulators and the second operation of circulating said working fluid in said first one of said accumulators to said heat receiving part and performs alternately said first and second operations in the reverse order in a second one of said accumulators.

2. The heat transmission device according to claim 1, wherein said control means comprises a switching means which selectively closes and opens pipelines for connection between said accumulators and said heat receiving part and between said accumulators and said heat radiating part.

3. The heat transmission device according to claim 2, wherein said switching means is constituted by a plurality of switching valves interposed in said pipeline and wherein switching operations for a first two of said switching valves associated with said first one of said accumulators are performed alternately and switching operations for a second two of said switching valves associated with said second one of said accumulators are performed in reverse to the operations of said first two of said switching valves.

4. The heat transmission valve according to claim 2, wherein said switching means is constituted by a plurality of check valves, one of said check valves being provided in each of said pipelines, which allow the working fluid to flow only from said accumulators to said heat receiving part and from said heat radiating part to said accumulators.

5. The heat transmission device according to claim 1, wherein said heating/cooling means is constituted by a thermoelectric element utilizing the Peltier effect.

6. The heat transmission device according to claim 2, wherein at least two accumulators are connected through a pressure equalizing pipe which is subjected to switching operations by said switching means.

7. The heat transmission device according to claim 1, wherein a gas reservoir filled with gas of non-condensing properties is connected to said accumulators.

8. The heat transmission device according to claim 7, wherein a switching valve as a switching means is provided in each of said pipelines for connecting said gas reservoir to said accumulators.

9. The heat transmission device according to claim 1, wherein:

(a) a liquid storage chamber in which a first porous material is packed is provided in a pipeline for connecting said heat receiving part to said accumulators;

(b) a heat receiving surface of said heat receiving part has an inner lining layer of a second porous material; and (c) said first and second porous materials are connected through a third porous material.

10. The heat transmission device according to claim 9, wherein the pore diameter of said second porous material is smaller than that of said first porous material.

11. The heat transmission device according to claim 9, wherein said heat receiving part is communicated with said liquid storage chamber.

12. The heat transmission device according to claim 1, wherein a separation preventing means is provided in said accumulators to prevent said heat transferring medium from separating into gas and liquid.

13. The heat transmission device according to claim 12, wherein said separation preventing means is constituted by a capillary tube having a small diameter which is connected to said pipeline.

14. The heat transmission device according to claim 12, wherein said separation preventing means is constituted by a number of capillary tubes arranged in parallel to each other.

15. The heat transmission device according to claim 12, wherein said separation preventing means is constituted by a packed porous material.

* * * * *